US009067222B2

(12) United States Patent
Gransow et al.

(10) Patent No.: US 9,067,222 B2
(45) Date of Patent: Jun. 30, 2015

(54) SPRAY FORMING ELEMENT FOR A SHOWER HEAD

(71) Applicant: Grohe AG, Hemer (DE)

(72) Inventors: Eckhard Gransow, Froendenberg (DE); Thomas Salomon, Guetersloh (DE); Karl-Heinz Stueckerjuergen, Verl (DE); David Rehage, Salzkotten (DE)

(73) Assignee: Grohe AG, Hemer (DE)

( * ) Notice: Subject to any disclaimer, the term of this patent is extended or adjusted under 35 U.S.C. 154(b) by 65 days.

(21) Appl. No.: 14/022,626

(22) Filed: Sep. 10, 2013

(65) Prior Publication Data

US 2014/0008462 A1 Jan. 9, 2014

Related U.S. Application Data

(63) Continuation of application No. PCT/EP2012/000565, filed on Feb. 8, 2012.

(30) Foreign Application Priority Data

Mar. 10, 2011 (DE) ..... 10 2011 013 534

(51) Int. Cl.

| | |
|---|---|
| ***B05B 3/04*** | (2006.01) |
| ***B05B 1/12*** | (2006.01) |
| ***B05B 15/06*** | (2006.01) |
| ***B05B 1/18*** | (2006.01) |
| ***B05B 1/14*** | (2006.01) |

(52) U.S. Cl.

CPC ..... *B05B 1/12* (2013.01); *B05B 3/0422* (2013.01); *B05B 15/066* (2013.01); *B05B 15/067* (2013.01); *B05B 1/18* (2013.01); *B05B 1/14* (2013.01); *B05B 3/0418* (2013.01)

(58) Field of Classification Search

CPC ..... B05B 1/12; B05B 1/18; B05B 1/14; B05B 3/0418; B05B 3/0422; B05B 15/066; B05B 15/067

USPC ..... 239/214.15, 222.11, 222.17, 222.21, 239/236, 237, 240, 241, 380–383, 525, 530, 239/548, 552, 556, 558, 559, 587.1, 587.4, 239/587.5

See application file for complete search history.

(56) References Cited

U.S. PATENT DOCUMENTS 1,011,934 A * 12/1911 Fellows ..... 239/240
4,018,385 A * 4/1977 Bruno ..... 239/381

(Continued)

FOREIGN PATENT DOCUMENTS

DE 199 12 104 A1 9/2000
DE 100 11 503 A1 9/2001

(Continued)

*Primary Examiner* — Steven J Ganey
(74) *Attorney, Agent, or Firm* — Muncy, Geissler, Olds & Lowe, P.C.

(57) ABSTRACT

In a spray forming element for a shower head having a housing, a plurality of axial-flow spray outlet elements, a housing base which has passage openings for the spray outlet elements, each of the spray outlet elements being pivotably mounted in the housing base, and which additionally has a gear mechanism for moving the spray outlet elements, in order to transmit a force to the spray outlet elements, a single gear element having a gate is provided, by means of which the spray outlet elements are positively guided and, during a movement of the gear element, the movement of all the spray outlet elements is carried out simultaneously.

12 Claims, 5 Drawing Sheets

(56) References Cited

U.S. PATENT DOCUMENTS

| | | | | |
|---|---|---|---|---|
| 5,332,155 | A * | 7/1994 | Jager | 239/240 |
| 6,360,967 | B1 | 3/2002 | Schorn | |
| 6,845,921 | B2 | 1/2005 | Schorn | |
| 7,946,512 | B2 * | 5/2011 | Schorn | 239/428.5 |
| 8,403,240 | B2 * | 3/2013 | Chen | 239/240 |

FOREIGN PATENT DOCUMENTS

| | | | |
|---|---|---|---|
| WO | WO 2007/011424 | A1 | 1/2007 |
| WO | WO 2010081409 | A1 * | 7/2010 |

* cited by examiner

SPRAY FORMING ELEMENT FOR A SHOWER HEAD

This nonprovisional application is a continuation of International Application No. PCT/EP2012/000565, which was filed on Feb. 8, 2012, and which claims priority to German Patent Application No. DE 10 2011 013 534.0, which was filed in Germany on Mar. 10, 2011, and which are both herein incorporated by reference.

BACKGROUND OF THE INVENTION

1. Field of the Invention

The present invention relates to a spray forming element for a shower head.

2. Description of the Background Art

DE 100 11 503 A1, which corresponds to U.S. Pat. No. 6,845,921 discloses a shower head for a sanitary shower in which a spray outlet element is pivotably mounted. It is moved by a gear mechanism so that a guide journal, facing away from the outlet opening, can be moved along two closed, touching circles.

DE 199 12 104 A1, which corresponds to U.S. Pat. No. 6,360,967, further discloses a shower head which in its interior contains four jet elements whose front ends are mounted in funnel-shaped apertures of the jet disk. The rear ends of the nozzle elements are mounted eccentrically in a disk which can be rotated around a fixed axis by a turbine wheel. As a result, the nozzle elements out of which the water flows perform a wobbling movement around an axis perpendicular to the jet disk.

SUMMARY OF THE INVENTION

It is therefore an object of the present invention to provide an improved spray forming element for a shower head with which a moving spray pattern can be produced.

The spray forming element for a shower head has a housing, a plurality of axial-flow spray outlet elements, a housing base, which has passage openings for the spray outlet elements, each of the spray outlet elements being pivotably mounted in the housing base, and a gear mechanism for moving the spray outlet elements. It is provided according to the invention that to transmit a force to the spray outlet elements only one gear element having a gate is provided by which the spray outlet elements are positively guided, so that during movement of the gear element, movement of all spray outlet elements occurs simultaneously. The spray forming element can be disposed in a shower head having a plurality of spray forming elements to generate different types of sprays, such as, for example, aerated sprays or single sprays, etc. It is also conceivable, however, that the housing of the spray forming element corresponds to the shower head housing or is disposed alone therein.

The spray forming element according to the invention produces a shower spray pattern with a plurality of individual sprays, which are formed by the axial-flow spray outlet elements. Because the spray outlet elements are mounted movable in the housing, variable spray patterns can be formed from these individual sprays.

In an embodiment, the spray outlet elements are set in motion by a gear mechanism. In this regard, the spray outlet elements are mounted undisplaceable but pivotable in the housing base. During movement of the spray outlet element, its tilt relative to the central axis of the housing and thus the tilt of the individual sprays are changed.

Overall, a spray pattern can be produced thereby whose individual sprays diverge or converge depending on the position of the gate relative to the housing axis. A massage effect on the user is achieved by movement of the individual sprays. A frequency at which the shower spray runs through about 60-100 movement cycles per minute is perceived as calming. Per cycle the spray outlet element is moved from a first angular position, which is tilted inward relative to the central housing axis, to a second angular position, which is tilted outward relative to the central housing axis, and back again. The frequency can be changed depending on the flow rate.

Advantageously, the spray outlet elements can be provided as small axial-flow nozzles, so-called swivel nozzles, with a circular cross section. They have a lower outlet region, a middle region, and an upper guide region for the gate. In the middle region, the outside diameter of the spray outlet elements is increased relative to the outlet region, so that spray forming elements can be retained by the housing base.

According to an embodiment of the invention, the spray outlet elements each have a swivel axis in the form of one or two journals. Advantageously, the journals can be formed in the middle region of the spray outlet elements. The swivel axis, which is defined by the journals, thus runs perpendicular to the flow direction or to the longitudinal axis of the nozzle.

An embodiment of the invention provides that the spray outlet elements are arranged concentric to the central axis of the housing. This means that the bearing devices for the spray outlet elements and their swivel axes are arranged on a circular path around the central axis of the spray forming element or the housing thereof. In this case, bearing cups for the swivel axes of the spray outlet elements are provided in the housing base.

An embodiment the invention provides that the gate of the gear element is provided as a groove or slit. The gate is located on the bottom side of the gear element. In the assembled state, the nozzles or spray outlet elements in their upper guide region are surrounded on both sides tangentially by the gate, so that when the gate moves, the pivotable spray outlet elements are forced to move.

Because a specific movement cycle of the spray outlet elements is sought for the desired massage effect, the gate should move only at a specific rotational speed. A turbine known from the state of the art, which is set in motion by the inflowing water in the spray former housing, is initially provided as a drive for the gear mechanism. The rotational speed of the turbine depends on its diameter and the flow. To reduce the rotational speed according to the desired movement cycle for the spray outlet elements, a reduction gear in miniaturized form is provided in the housing.

An embodiment of the invention provides that the gear mechanism is designed as a planetary gear. Hereby, the gate for the positive guiding of the spray outlet elements is provided in a gear element, the hollow wheel of the planetary gear. This so-called hollow gate wheel is driven in turn by the planetary wheels of the planetary gear.

Advantageously, the movement of the spray outlet elements as predetermined by the gate can occur synchronously. Further, all spray outlet elements have the same swivel angle at the same time. This is achieved by a gate with a wavy contour. To achieve the previously described effect, the wave crests and troughs of the wavy contour are at a constant distance and each have the same height or depth.

However, depending on the gate design, the spray outlet elements can also be moved offset to one another. This is possible by a suitable change in gate shape or a change in the wave distances and wave heights.

An embodiment of the invention moreover provides that passage openings for the water within the spray forming element can be partially closed. As a result, a pulsating spray can be produced in addition to the desired moving spray pattern.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
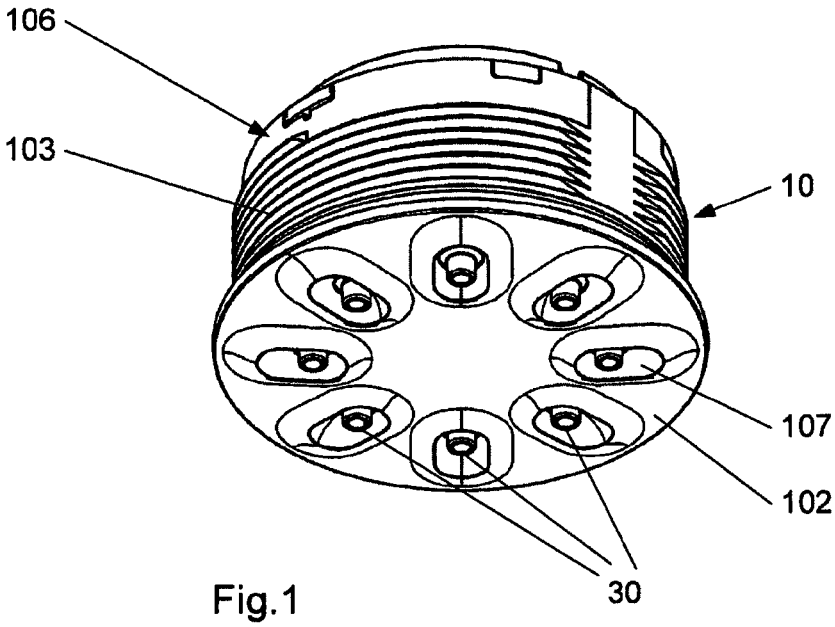
FIG. 1 shows a spray forming element of an embodiment of the invention perspectively from below.

FIG. 1 shows a spray forming element of the invention perspectively from below. The spray forming element comprises a housing 10 having a housing base 102, in which movable spray outlet elements 30, so-called swivel nozzles, are mounted. Housing 10 has a substantially cylindrical form, whereby an outer thread 103 is arranged in its casing area 106. Outer thread 103 is used to attach the spray forming element in a shower head (not shown), which may have other spray forming elements or a spray disk.

Figure 2:
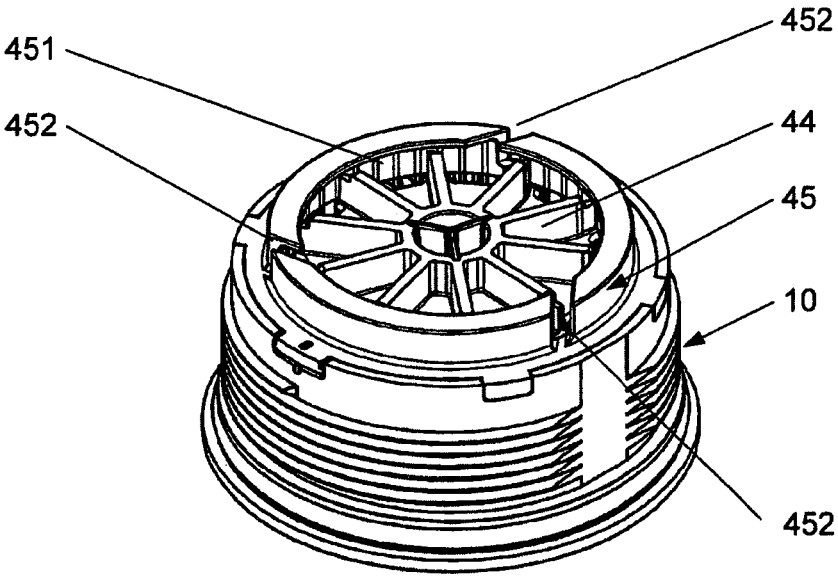
FIG. 2 shows a spray forming element of the invention perspectively from above.

It becomes apparent from FIG. 2 that housing 10 is open at the top. It ends at its upper edge with a hollow wheel 45 firmly fixed to housing 10. Hollow wheel 45 is part of a gear mechanism 40 with which spray outlet elements 30 can be set in motion due to inflowing water.

Hollow wheel 45 is firmly locked with housing 10 and has internal toothing 451. In the casing area of hollow wheel 45 moreover three slit-shaped inlet openings 452 are arranged through which the inflowing water is taken radially to a turbine wheel 44 arranged within hollow wheel 45.

Figure 5:
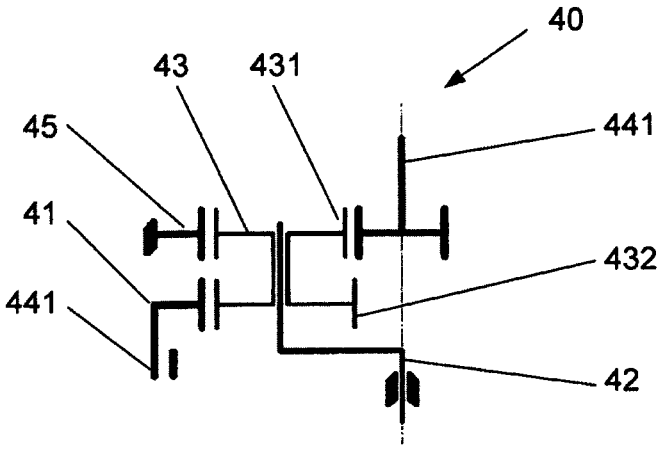
FIG. 5 shows a schematic illustration of a reduction gear, which is disposed in the spray forming element.
Figure 6:
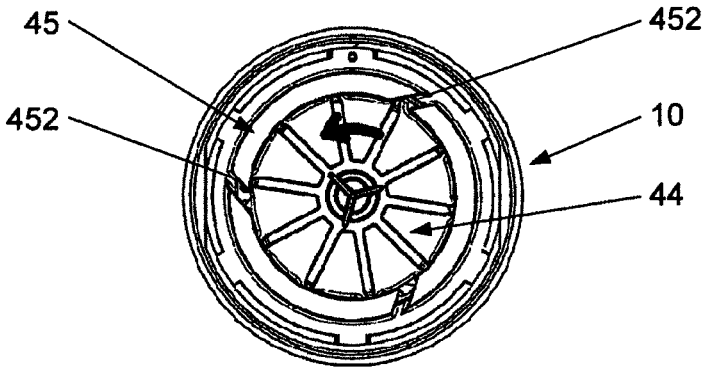
FIG. 6 shows a sectional view through the spray forming element of FIG. 3 along the line VI-VI.
Figure 7:
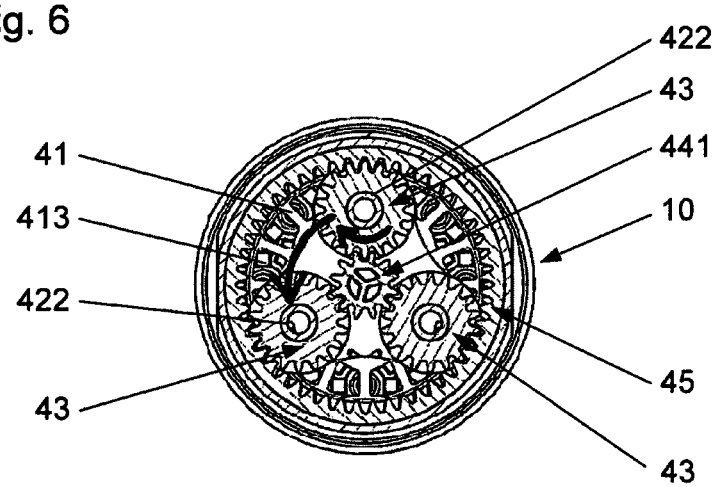
FIG. 7 shows a sectional view through the spray forming element of FIG. 1 along the line VII-VII.
Figure 8:
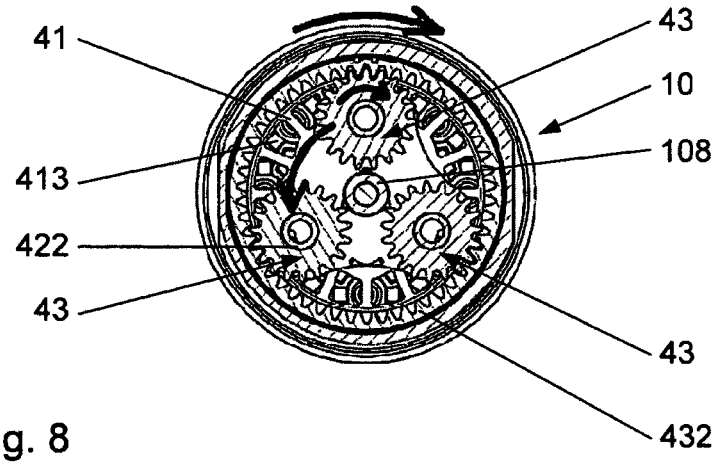
FIG. 8 shows a sectional view through the spray forming element of FIG. 1 along the line VIII-VIII.

FIG. 5 schematically shows the structure of gear mechanism 40. A movable sun wheel 441 drives a planet wheel 43, which is mounted on a planet web 42. In this regard, planet wheel 43 is a single piece but provided with two different toothings 431, 432. An upper toothing 431 engages sun wheel 441 and a hollow wheel 45, whereas a bottom toothing 432 engages another hollow wheel, the so-called hollow gate wheel 41. A gate 411, which forms a bearing or positive guiding for spray outlet elements 30, is disposed on the side of hollow gate wheel 41, said side facing the spray outlet elements 30.

Figure 3:
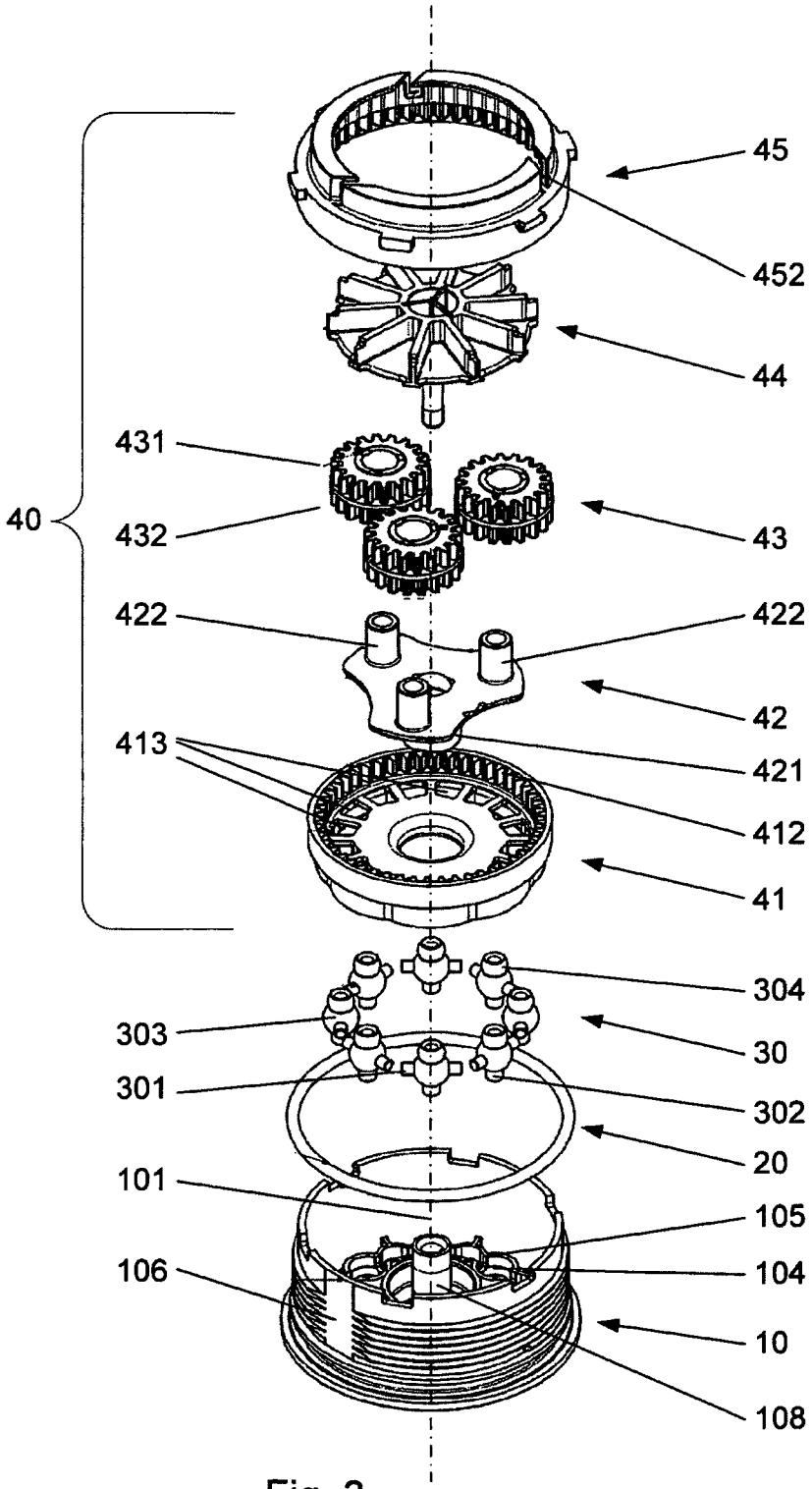
FIG. 3 shows an exploded illustration of the spray forming element of FIG. 1.
Figure 4:
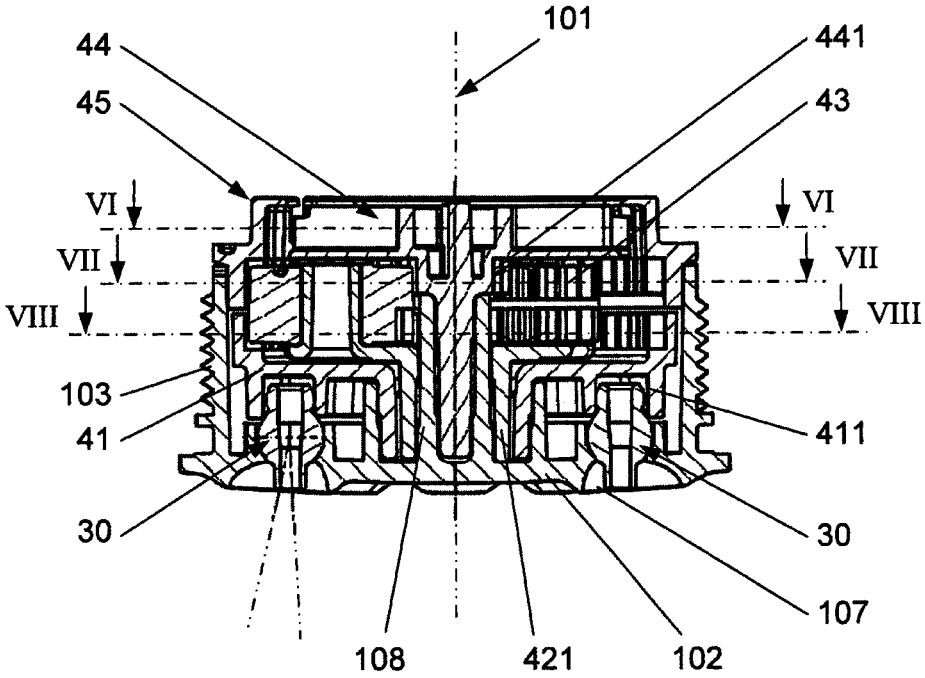
FIG. 4 shows a sectional view through a spray forming element of the invention.

The spray forming element is shown in an exploded view in FIG. 3.

In housing 10 first a sealing element 20 is disposed, which makes sure that the inflowing water leaves the spray forming element only via the openings of spray outlet elements 30 and not through passage openings 107 in housing base 102.

Housing base 102, on the one hand, has bearing surfaces 105 for spray outlet elements 30 and, on the other, bearing cups 104 for swivel axes 301 of spray outlet elements 30. Spray outlet elements 30 are provided as swivel nozzles. They have a bottom outlet region 302, a middle region 303, and an upper guide region 304 for gate 411. In the middle region 303, the outer diameter of spray outlet elements 30 is enlarged relative to outlet region 302, so that spray outlet elements 30 can be retained by housing base 102.

A hollow gate wheel 41, which is driven by planet wheels 43, is disposed above spray outlet elements 30. For this purpose, a planet web 42, which is mounted rotatable by means of a bearing sleeve 421 on a suitable bearing journal 108 in housing base 102, is provided between hollow gate wheel 41 and the three planet wheels 43. Three fixed bearing journals 422 are also disposed on the side of planet web 42, said side facing the top side of the housing, for a rotatable mounting of planet wheels 43.

Planet wheels 43 as already described above are driven by a sun wheel 441. This wheel is disposed on the bottom side of turbine wheel 44, which is driven by the inflowing water.

The corresponding rotation directions of gear elements 41, 42, 43, 44 become clear from FIG. 4 and FIG. 6 to FIG. 8.

As soon as water flows into the spray forming element through inlet openings 452, it is taken to the blades of turbine wheel 44, which is set in motion as a result. Sun wheel 441 of gear mechanism 40 is located on the bottom side of turbine wheel 44 and connected rotationally fixed to it. Sun wheel 441, which moves at the speed of turbine wheel 44, drives the three planet wheels 43, which, on the one hand, are mounted rotatable on planet web 42 but simultaneously with their upper toothing 431 engage internal toothing 451 of stationary hollow wheel 45. In this way, planet web 42 together with planet wheels 43 performs a rotation within hollow wheel 45.

Figure 9:
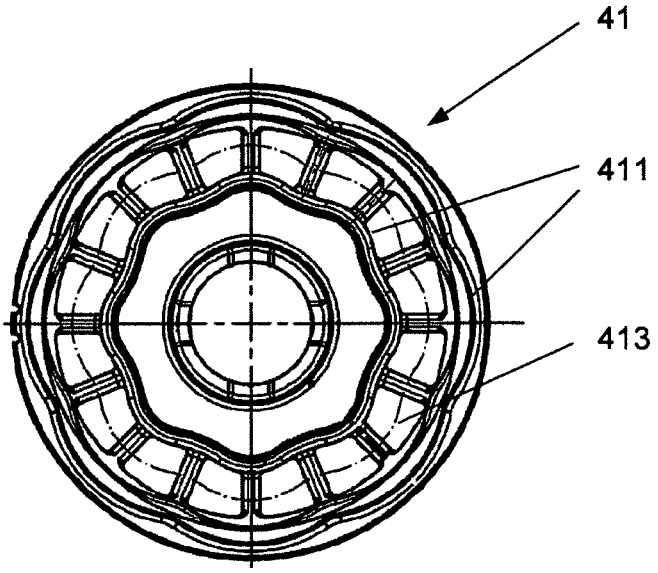
FIG. 9 shows a bottom view of a hollow gate wheel.

Planet wheels 43 with their lower toothing 432 simultaneously engage hollow gate wheel 41. The gate wheel is penetrated by bearing sleeve 421 and moreover has a number of water passage openings 413, which corresponds to the number of spray outlet elements 30. A gate 411 in the form of a closed groove with a wavy contour is disposed on the bottom side of hollow gate wheel 41. Gate 411 has a number of wave crests and troughs corresponding to the number of spray outlet elements 30, as is clear from FIG. 9.

Hollow gate wheel 41 is also mounted rotatable on bearing journal 108 of housing 10 and is driven via the bottom toothing 432 of planet wheels 43.

With the use of the selected gear ratios a reduction of the turbine wheel by more than 300 times is achieved in the smallest space here. At a turbine speed of "n," which results from the flow pressure it is achieved thereby that the gate wheel has only a rotational speed of about n/300. As described above, gate 411 in hollow gate wheel 41 has such a form that all positively guided spray outlet elements 30 at a rotation of gate hollow wheel 41 are swiveled back and forth around their swivel axis 301 as frequently as spray outlet elements 30 are provided in the spray forming element. Thus, for spray outlet elements 30 depending on the flow pressure of the inflowing water, for example, a movement frequency of 60 to 200 cycles per minute can be achieved. Tests by the applicant have shown that during a swiveling movement of spray outlet elements 30 at a frequency of 60 to 100 cycles per minute, a calming massage effect is exerted on the user, whereas at an increased flow pressure and a correspondingly increased frequency of 150 to 200 movement cycles per minute a stimulating effect can be achieved.

During a movement cycle, spray outlet elements 30 can perform movements at a swivel angle of approximately 20°, so that the individual sprays, generated by the axial-flow swivel nozzles 30, depending on the position of gate 411 diverge or converge toward the central axis of housing 10. The aim in the present case is that swivel nozzles 30 move synchronously at all times and thus are also swiveled at any time at the same swivel angle relative to central housing axis 101.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

LIST OF REFERENCE CHARACTERS

10 Housing
101 Central axis, central housing axis
102 Housing base
103 Outer thread
104 Bearing cup
105 Bearing surface
106 Casing area
107 Passage openings
108 Bearing journal for planet web
20 Sealing element
30 Spray outlet element, swivel nozzle
301 Swivel axis
302 Bottom outlet region
303 Middle region
304 Guide region
40 Gear mechanism
41 Gear element, hollow gate wheel
411 Gate
412 Toothing
413 Water passage opening
42 Planet web
421 Bearing sleeve
422 Bearing journal
43 Planet wheel
431 Upper toothing
432 Bottom toothing
44 Turbine wheel
441 Sun wheel
45 Hollow wheel
451 Internal toothing
452 Inlet opening

What is claimed is:

1. A spray forming element for a shower head, comprising:
a housing;
at least two axial-flow spray outlet elements;
a housing base having passage openings for the spray outlet elements, the at least two spray outlet elements configured to be pivotably mounted in the housing base; and
a gear mechanism configured to move the spray outlet elements;
the gear mechanism including a rotatable gear element configured to transmit a force to the at least two spray outlet elements, the gear element having a gate via which the spray outlet elements are positively guided and wherein during movement of the gear element, the movement of the at least two spray outlet elements occurs simultaneously, and
wherein the at least two spray outlet elements each pivot along a respective swivel axis, the respective swivel axes being substantially perpendicular to an axis of rotation of the gear element.

2. The spray forming element for a shower head according to claim 1, wherein one or two journals or nipples is provided for each spray outlet element along the swivel axes.

3. The spray forming element for a shower head according to claim 1, wherein the spray outlet elements are arranged concentric to the central axis of the housing.

4. The spray forming element for a shower head according to claim 2, wherein bearing cups that retain the one or two journals or nipples of the spray outlet elements are arranged in the housing base.

5. The spray forming element for a shower head according to claim 1, wherein the gate of the gear element is a groove or slit.

6. The spray forming element for a shower head according to claim 5, wherein the groove or slit has a wavy contour.

7. The spray forming element for a shower head according to claim 1, wherein the gear mechanism is a reduction gear.

8. The spray forming element for a shower head according to claim 1, wherein a planetary gear is provided as the gear mechanism.

9. The spray forming element for a shower head according to claim 8, wherein the gate for the positive guidance of the at least two spray outlet elements is provided in a hollow wheel of the planetary gear.

10. The spray forming element for a shower head according to claim 1, wherein the pivot motion of the at least two spray outlet elements occurs by the positive guidance of the gate synchronously and in each case at the same rotation angle.

11. A spray forming element for a shower head, comprising:
a housing;
at least two axial-flow spray outlet elements;
a housing base having passage openings for the at least two spray outlet elements, the at least two spray outlet elements being pivotably mounted in the housing base; and
a planetary gear configured to move the spray outlet elements;
the planetary gear including a hollow gate wheel that transmits a force to the at least two spray outlet elements, the hollow gate wheel having a gate provided therein via which the spray outlet elements are positively guided,
wherein during movement of the gear element, the movement of the at least two spray outlet elements occurs simultaneously.

12. The spray forming element according to claim 11, wherein the hollow gate wheel is rotatable and wherein the at least two spray outlet elements each pivot along a respective swivel axis, the respective swivel axes being substantially perpendicular to an axis of rotation of the hollow gate wheel.

* * * * *